US011077918B2

(12) United States Patent
Vodopianov

(10) Patent No.: US 11,077,918 B2
(45) Date of Patent: Aug. 3, 2021

(54) STABILIZED HULL FOR A KEELED MONOHULL SAILBOAT OR SAIL AND MOTOR BOAT

(71) Applicant: Ignat Mikhailovich Vodopianov, St. Petersburg (RU)

(72) Inventor: Ignat Mikhailovich Vodopianov, St. Petersburg (RU)

( * ) Notice: Subject to any disclaimer, the term of this patent is extended or adjusted under 35 U.S.C. 154(b) by 351 days.

(21) Appl. No.: 16/066,045

(22) PCT Filed: Feb. 2, 2016

(86) PCT No.: PCT/RU2016/000041
§ 371 (c)(1),
(2) Date: Jun. 25, 2018

(87) PCT Pub. No.: WO2017/111652
PCT Pub. Date: Jun. 29, 2017

(65) Prior Publication Data

US 2020/0262517 A1 Aug. 20, 2020

(30) Foreign Application Priority Data

Dec. 24, 2015 (RU) ..... RU2015155664

(51) Int. Cl.
*B63B 39/06* (2006.01)
*B63B 1/04* (2006.01)
(Continued)

(52) U.S. Cl.
CPC ..... *B63B 1/042* (2013.01); *B63B 1/18* (2013.01); *B63B 3/38* (2013.01); *B63B 2001/186* (2013.01); *B63B 2003/385* (2013.01)

(58) Field of Classification Search
CPC ..... B63B 1/042; B63B 2001/186; B63B 2001/203; B63B 2001/204;
(Continued)

(56) References Cited

U.S. PATENT DOCUMENTS 4,924,797 A * 5/1990 Solia ..... B63B 1/20 114/283
4,981,099 A 1/1991 Holder
(Continued)

FOREIGN PATENT DOCUMENTS

AT 406143 B 2/2000
DE 4125187 A1 2/1993
(Continued)

OTHER PUBLICATIONS

International Preliminary Report on Patentability dated Jun. 26, 2018, in International Application No. PCT/RU2016/000041, filed Feb. 2, 2016; 5 pages.

*Primary Examiner* — Andrew Polay
(74) *Attorney, Agent, or Firm* — Thorpe North & Western

(57) ABSTRACT

The invention relates to boat building and can be used in the building and modification of sea-going high-speed keeled monohull sailboats or sail and motor boats with a high sail power to weight ratio, where a single, narrow, wave-penetrating displacement hull is used. To provide for the stable controlled movement of a keeled monohull sailboat or sail and motor boat in wave penetration mode, i.e. in a low wave/hydrodynamic resistance displacement mode, both when heeling and when upright (at the same time effectively counteracting heeling and rocking on all courses), and to provide for the damping of the energy of a broken wave and also for the ability of the boat to self-right to an even keel from a "sail-on-water" position, a stabilized hull for a keeled monohull sailboat or sail and motor boat is configured with an overall width of not more than 50% of the length of the hull and has, in the bottom part thereof, a vertically oriented narrow section (4) of low wave/hydrodynamic resistance, which runs longitudinally along the full length of the boat, is symmetrical about the centreline thereof and has a displacement segment (5) comprising a keel (8) with a heavy
(Continued)

bulb, wherein the displacement of the segment is equal to the full unladen weight of the boat. The hull further comprises two narrow longitudinally oriented sponsons (6 and 7), arranged symmetrically in relation to the centreline of the boat, which do not bear the weight of the boat and which have a streamlined shape of low wave/hydrodynamic resistance. Said sponsons are situated above the waterline at the maximum width of the hull, forming two tunnel cavities (10) above the waterline to dampen the energy of a wave broken by the bow and the sponsons.

1 Claim, 3 Drawing Sheets

(51) Int. Cl.
*B63B 1/18* (2006.01)
*B63B 3/38* (2006.01)

(58) Field of Classification Search
CPC ..... B63B 2001/205; B63B 2001/207; B63B 2001/208; B63B 3/38; B63B 2003/385
See application file for complete search history.

(56) References Cited

U.S. PATENT DOCUMENTS

| | | | | |
|---|---|---|---|---|
| 5,211,126 | A * | 5/1993 | Johnson | B63B 1/042 114/288 |
| 5,937,777 | A * | 8/1999 | Azima | B63B 1/042 114/123 |
| 6,250,245 | B1 * | 6/2001 | Robinson | B63B 1/042 114/288 |
| 6,314,903 | B2 * | 11/2001 | Robinson | B63B 1/042 114/288 |
| 6,435,123 | B1 * | 8/2002 | .O slashed.deg.ang.rd | B63B 1/24 114/274 |
| 2008/0210149 | A1 | 9/2008 | Goubault et al. | |
| 2013/0340666 | A1 | 12/2013 | Argo | |

FOREIGN PATENT DOCUMENTS

| | | | | |
|---|---|---|---|---|
| EP | 0298050 | A1 | 1/1989 | |
| EP | 2769909 | A2 | 8/2014 | |
| FR | 2876346 | A1 | 4/2006 | |
| RU | 2172697 | C1 | 8/2001 | |
| RU | 2562086 | C2 | 9/2015 | |
| WO | WO 9002075 | A * | 8/1988 | B63B 1/042 |
| WO | WO 2008/000838 | A1 | 1/2008 | |

* cited by examiner

STABILIZED HULL FOR A KEELED MONOHULL SAILBOAT OR SAIL AND MOTOR BOAT

FIELD OF THE INVENTION

The invention relates to shipbuilding and may be used in construction and modification of high-speed sea-going monohull keeled sail/power-sail boats with a high sail area to weight ratio where a single narrow wave-piercing displacement hull is used.

PRIOR ART

The ratio of the displacement hull length along its waterline to its width along the waterline (waterline relative elongation, L/W WL) characterizes the ship's propulsion (the higher the L/W WL, the faster the ship) and stability (the lower the L/W WL, the more stable the ship).

A narrow displacement hull possesses a number of advantages over wider hulls. Foremost, it is low wave-making/hydrodynamic resistance in motion which allows high speeds to be reached before starting to plane. Another advantage is high seaworthiness and stable run, as the fine bow and the narrow body "pierce" the wave minimizing the loads on the ship's structure and the pitch motion. The hulls with L/W WL of 7× times and more are called "wave-piercing".

The narrow hull main deficiency is in its poor stability—the long narrow hull readily capsizes under the impact of waves and/or heel under sail. Another deficiency is high requirements to the quality of the submerged surface, given its comparatively large wetted surface and the resulting considerable friction force.

The monohull sail/power-sail boats built in the early XX century, for example, the barques "Sedov" and "Kruzenshtern", have L/W WL about 7× times (i.e. narrow hulls) and develop speed up to 18 knots under sail. Their relatively low sail area to displacement ratio (0.6-0.7 m2 per one tonne of displacement), large absolute hull width (about 14 m with 100 m length) and the availability of ballast allow their relatively narrow hull to be stabilised against rolling or heeling under sail.

Modern monohull keeled sail/power-sail boats (hereinafter, "monohull keeled boats") have become smaller (most are less than 24 metres long), their hulls are relatively wider (L/W WL less than 5× times)—which is necessary for comfort and stability, given comparatively small absolute size; at the same time, in order to reach their rated speed, monohull keeled boats have high sail area to displacement ratio of 7-10 m2 or more per one tonne of displacement (i.e. exceeding 10+ times that ratio of the sail boats built at the beginning of the XX century), which requires an efficient resistance against heeling under sail.

The ability of a monohull keeled boat to resist heeling under sail depends on the ballast weight located in the heavy bulb in the keel lower part, and on the sail boat hull width. The heavier the ballast and the wider the hull (and, correspondingly, bigger lever arm of the applied bulb weight, as compared to the displacement centre at heeling), the more stable the monohull keeled boat and the higher sail area to displacement ratio it may have without capsizing on the leeward side. Wider hulls have both positive and negative aspects.

Positive—the monohull keeled boat may have a high sail area to displacement ratio (7-10 m2 or more per tonne of displacement), the internal space of the boat is large and may be used for comfortable accommodation of the crew and the equipment during extended voyages. Under certain conditions (and with experienced crew), the wider hull is capable of planning, thereby developing higher speeds under sail, which is important for racing sail boats.

Negative—a wide hull creates a high wave resistance in the displacement mode, and the rated speeds of modern cruise monohull keeled boats do not exceed 8-9 knots; in case of further speed increase, the hull moves in the transitional mode thereby creating high wave resistance. Wide hulls experience wave shocks at stern and sides, while their fine narrow bow tends to "bury" into the wave at heel under sail. In case of a considerable shift of the displacement centre towards the side (with further increase in the hull width), a wide hull loses its capability to independently return to even keel from "sails on water" position.

For power boats, which use narrow displacement hulls, where there is no heel under sail, many stabilization features have been realised, both for conventional and "small waterline area" narrow hulls.

For multi-hull sail/power-sail boats, an efficient narrow hull stabilization system has been realised by catamaran (two equal widely spaced narrow hulls) and trimaran (one narrow hull and two widely spaced floats) designs. Such vessels are capable of carrying a high sail area to displacement ratio; they develop high speeds in the displacement mode and possess good seaworthiness. The main deficiency which limits the use of multi-hull sail/power-sail boats is lack of capability to independently return to even keel from "sails on water" position; thus, the survivability of such vessels in the open sea is doubtful. Another important deficiency is lack of comfort for the crew in extended voyages, as the living quarters are located in the very narrow hulls.

U.S. Pat. No. 2,437,797 granted under PCT application WO2008/00083820080103, shows a boat which relates to high-speed vessels with high seaworthiness allowing them to be operated in very rough water conditions. The invention ensures a more stable flow of water along the boat bow, thereby enhancing the boat heading stability at low amplitudes of yaw angle. The boat to be used at high speeds and in rough water has a single long and narrow hull and more or less vertical bow and fixed vertical stabilisers or horizontal stabilisers at the boat stern. The stern stabilisers are the only additional element ensuring the stability of the long and narrow hull and protecting it against capsizing. Such design does not provide the stability necessary for compensating heeling under sail, which happens at speeds from zero to maximum.

U.S. Pat. No. 2,562,086 shows a device stabilising the motion of a surface monohull high-speed displacement boat (published on 10 Sep. 2015). The patent describes a motion stabilisation device of a surface monohull high-speed displacement boat with a narrow hull and sharp wedge-shaped bow, made in the form of a stern under-water wing and equipped with additional supports in the form of side profiled pillars. The stern wing is the only additional element ensuring the stability of the long and narrow hull and protecting it against capsizing. Such design does not provide the stability necessary for compensating heeling under sail, which happens at speeds from zero to maximum.

U.S. Pat. No. 4,981,099 (published on 1 Jan. 1991) shows a modified boat consisting of the above-water body, a long rigid underwater section or sections which partially compensate the boat displacement, thereby exerting impact on the speed, wave resistance, cargo capacity, etc.

It is true that the submerged part/parts of the hull compensate a considerable part of the boat displacement, and the parts of the hull at the boundary of the two media (thereby creating wave resistance) may thus be of minimum cross-section for minimizing specifically the wave resistance. This concept is also known as "Small Waterline Area" hull and is widely used, for instance, by the company Navatek Ltd. (Honolulu). The main deficiency of this solution is the position of the displacement centre much lower than the boat centre of gravity, deep under the waterline. Therefore, the boat has negative stability by default and tries to return to its stable position (i.e. bottom up), which in practice results in rolling and pitching in motion. The modern designs of such hulls are mostly intended to create the boat "artificial stability" in motion by using stabilisers/underwater wings and providing their computer control. Such design does not provide the stability necessary for compensating heeling under sail, which happens at speeds from zero to maximum.

Patent application US20130340666 (published on 26 Dec. 2013) shows extension of the boat hull by installing sponsons along the side chines. The hull extension may improve the boat stability and/or minimize the wetted surface. The concept is an option of a conventional non-displacement sponson, which is the only additional element ensuring the stability of the long and narrow hull and protecting it against capsizing. Such design does not provide the stability necessary for compensating heeling under sail, which happens at speeds from zero to maximum.

In considering the European application EP2769909 (published on 26 Feb. 2014), it should be noted that, despite similarity of certain structural elements, the solution is embodied on the basis of different principles, without the use of the main advantages of the narrow hull—it does not ensure wave piercing and seaworthiness, neither does it employ elements enhancing the stability at heel under sail.

The hull side members displace water and take part in supporting the main weight of the boat by their short wavelike thrust (not compensating pitching thereby), the horizontal elements connecting the hull and the side members are at the boundary of the media below the water line—i.e. the hull lower horizontal surface, along with its side members, takes part in wave generation, thereby creating wave resistance and not allowing wave piercing—on the contrary, the author states that the hull central part is designed especially for the wave to "strike it in the discrete mass point", thereby "uniformly lifting" the boat bow and stern. The seaworthiness of such design is doubtful, to say the least. The hull underwater shape is proposed in the form of "a profile with a dynamic lift" for reducing pitching, among other things, which also assumes the use of underwater stabilisers. Such elements are not able to function at comparatively low speeds of sailing. The water displacing side elements are not shifted to the boat maximum width and thus do not ensure the support resisting heeling under sail.

As a whole, the solution (despite the availability of a keel with a heavy bulb) is more applicable for power high-speed boats.

DISCLOSURE OF THE INVENTION

In the applicant's judgment, the proposed solution, unknown from the prior art, allows the use of a single narrow wave piercing displacement hull in the design of monohull keeled sail/power-sail boats with high sail area to displacement ratio, ensuring the following technical results:

- stable controlled motion of a monohull keeled sail/power-sail boat in the wave piercing mode, i.e. in displacement mode of low wave/hydrodynamic resistance, both with or without heel under sail, ensuring an efficient dissipation of the broken wave energy;
- provision of a powerful thrust and its long lever arm creating a proportional resistance to heeling under sail and hull swinging;
- reduction to the minimum of inertial moments acting on the hull;
- provision for boat unassisted return to even keel from critical heeling ("sails on water") position.

As a result, the said stabilised hull embodied on a seagoing high-speed monohull keeled sail/power-sail boat with a high sail area to displacement ratio (7-10 m2 or more per tonne of displacement), ensures, as compared with the prior art (monohull keeled sail/power sail boats):

- a considerable speed increase of 2× or more times in the displacement mode or (which is similar) a 2-fold reduction of energy expenditure (sail or engine) required for moving the boat from point A to point B;
- considerable enhancement of the boat seaworthiness and propulsion stability;
- more efficient resistance to heeling under sail and the absence of hull swinging during any motion under sail;
- similar capability to unassisted return to even keel after "sails on water";
- similar space and comfort of living quarters and excellent steering capabilities.

This result is attained by the embodiment of the stabilised hull of the monohull keeled sail/power sail boat featuring a hull with the total width not exceeding 50% of its length, which in its lower part

- is embodied with a longitudinally arranged, symmetrical in relation to the boat centerline and commensurate to its length, vertically oriented narrow section of low wave/hydrodynamic resistance, with a water displacement segment, including a keel with a heavy bulb,
- therein, the length-to-width ratio of that segment waterline is at least 7× times, with the segment water displacement corresponding to the fully loaded weight of the boat,
- therein, the narrow section is embodied with wave piercing lines, a high wave piercing stem, streamlined back lines, and a streamlined spatial widening in the upper front part thereof,
- it also includes two longitudinally oriented, symmetrical in relation to the boat centerline, sponsons, located above the waterline along the bottom surface of the hull at maximum hull width; in relation to the hull length, the sponsons may be located either closer to the stern, the middle or to the bow part of the hull,
- therein, the sponson length-to-width ratio is at least 7× times, with its own volume sufficient for parrying heeling under sail at submersion of the leeward sponson, but not sufficient for keeping the boat afloat,
- therein, the sponsons have a streamlined, spindle-shaped form with wave piercing front, streamlined rear and planning middle lines,
- forming above the waterline two tunnel cavities between the narrow section and each of the sponsons, of the size sufficient for dissipating the energy of the wave broken by the stem and the sponsons.

BRIEF DESCRIPTION OF THE DRAWINGS

The said design of the stabilised hull is illustrated by attached drawings.

Figure 1:
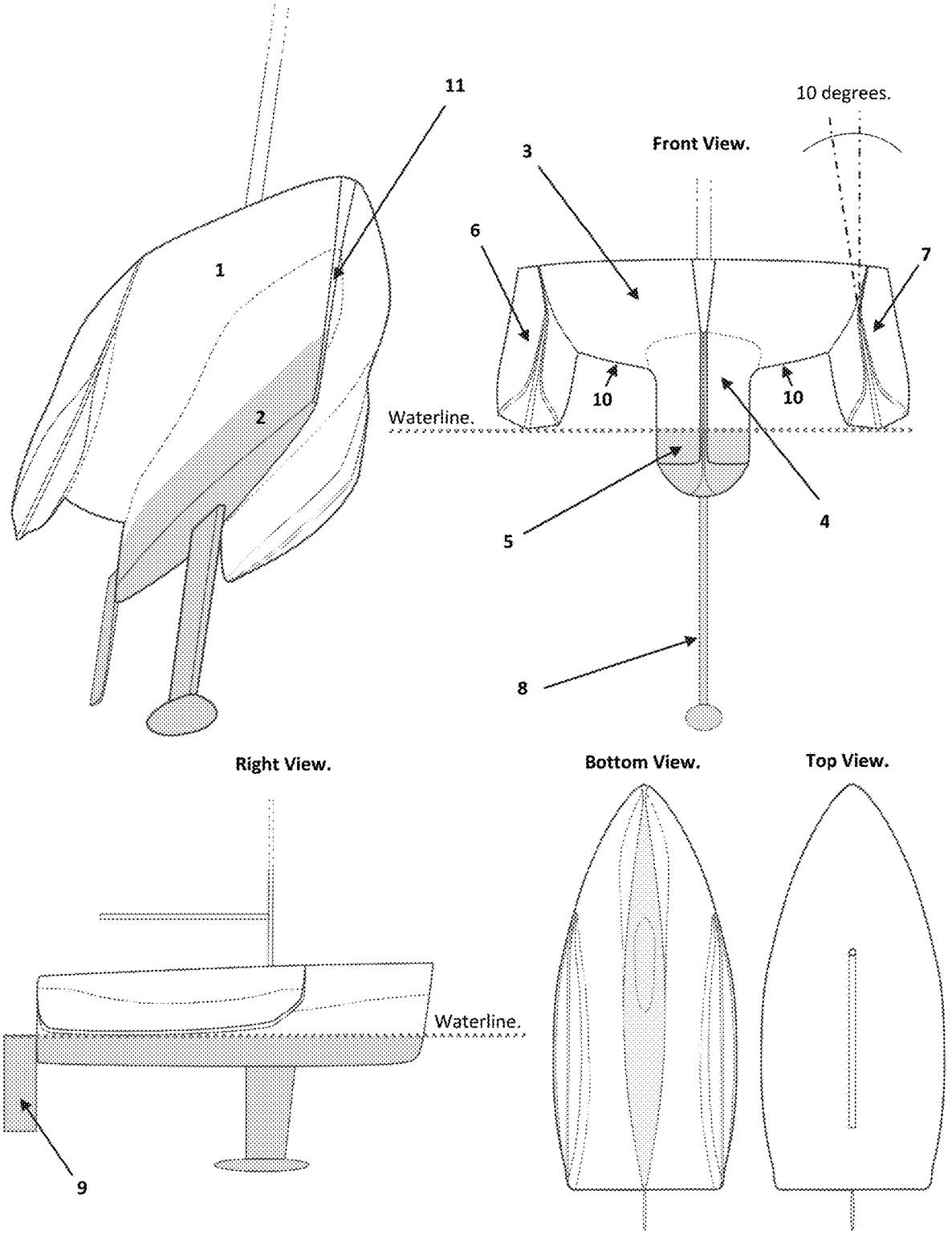
FIG. 1 features the general view of the hull of a monohull keeled sail/power-sail boat 1 (the engine is not shown on drawings), where dimmed section 2 shows its wetted surface at no heeling under sail—for instance at sailing downwind or using the engine. The main elements are upper part of the hull 3, narrow section 4 with wave piercing displacement segment 5, right-hand 6 and left-hand 7 sponsons, keel 8 with a heavy bulb, rudder blade 9, two tunnel cavities 10, high front wave piercing stem 11.

The narrow section 4 is stabilised by keel 8 with heavy bulb and rudder blade 9 which ensures the boat steering capabilities. The boat's heavy equipment and the water and fuel reserves (if they are necessary) are located in the lower part of the narrow section 4, thus minimising the inertia moments of their weight at the hull movements. The segment 5 water displacement corresponds (within 80-100% range) to the fully loaded weight of the boat ready for travel, including the crew, the keel with a heavy bulb, the equipment and water and fuel reserves (if they are necessary), etc. Thus, the sponsons 6 and 7 do not take part in keeping the boat afloat.

The symmetric right-hand 6 and left-hand 7 sponsons are equally spaced from the boat centerline at the maximum hull width above the waterline. The location of the sponsons at the hull maximum width ensures a large lever arm of the sponson's displacement force, resisting heeling under sail and the hull swinging.

FIG. 1 shows the arrangement of the sponsons along the hull length closer to its stern; it is also possible to locate the sponsons closer to its middle or the front.

The installation angle of the sponsons in relation to the boat centerline (on FIG. 1, an angle of 10 degrees is shown) is appropriate for ensuring symmetrical water flow motion at submersion of the leeward sponson.

Figure 2:
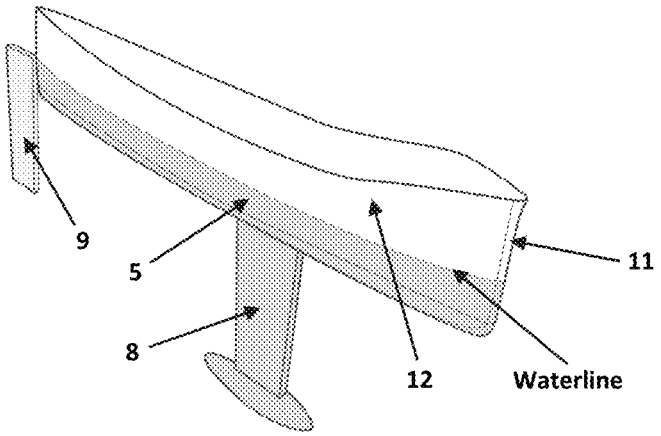

The narrow section 4 (FIG. 2) is long, narrow, with elevated forms of low wave/hydrodynamic resistance, relative elongation of the water line L/W WL of at least 7× times, thereby ensuring the displacement wave piercing mode and the laminarity of the water flow along its entire length, ensuring the cutting and passing of the wave along the narrow section with minimum impact on the boat speed. The high wave piercing stem 11 cuts the wave with minimum speed loss. In its front part, the narrow section 4 features a spatial widening 12 which reduces the pitching magnitude.

Figure 3:
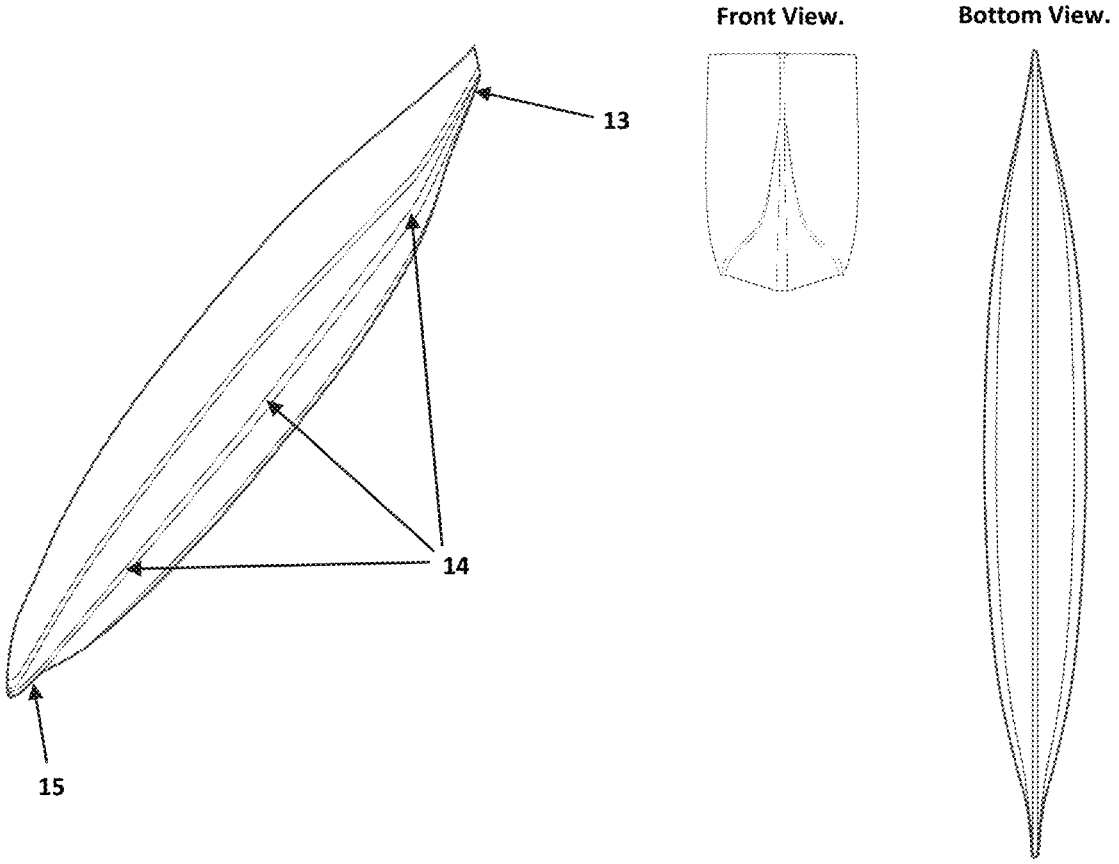

FIG. 3 shows sponsons details where symmetric right-hand 6 and left-hand 7 sponsons are made narrow, long, with elevated forms of low wave/hydrodynamic resistance, relative elongation of their shape (length-to-width ratio) of at least 7× times, thereby ensuring wave piercing and laminarity of the water flow along the entire length of the leeward sponson at its submersion under the impact of heeling under sail.

The sponson has three types of lines in its design—wave piercing 13 in its front part, planning ("deep V") 14 in the middle part and streamlined 15 in the rear part. The sponson body is of streamlined spindle shape, having a volume sufficient for parrying the heeling under sail by the force of its displacement at submersion of the leeward sponson, and also for parrying the boat swinging at all sailing modes. At the same time, the sponson volume is not sufficient for keeping the boat afloat—thus, at critical heeling when the boat is in "sails on water" position, the leeward sponson is fully submerged, thereby preventing the hull from "tipping over" into a stable lying position through the displacement body, as it happens, for instance, with catamarans and trimarans.

The absence of boat weight carried by the sponsons, and their location at the maximum hull width at a long distance from the boat centerline and above the waterline, are the most important conditions of functioning of the claimed stabilised hull, because only if the above conditions are all simultaneously met, then:

- the leeward sponson embodiment may be of small volume for an efficient resistance against heeling under sail, with narrow streamlined shape and with the length-to-width ratio of at least 7× times, thus having a wave piercing shape, thereby exerting little impact on the boat speed at its submersion due to heeling under sail;
- the narrow shape of the sponsons and their wide spacing allow two tunnel cavities 10 to be formed between the narrow section 4 and sponsons 6 and 7 where cavities 10 minimise the wetted surface at the boundary of the media and where, in cavities 10, the energy of the wave broken by the stem and the front lines of the sponsons is dissipated;
- with no heeling under sail (for instance, sailing downwind or using engine), the middle lines of such sponsons, located above the waterline and free of load, actively plane, thereby exerting minimum wave resistance to motion;
- at critical "sails on water" position, the small volume leeward sponson is not capable of carrying the boat weight and it submerges, thereby preventing the hull from "tipping over the sponson", and the return to even keel occurs independently, just like in modern monohull keeled boats.

The claimed stabilised hull may be embodied, for instance, from fiberglass or other composite materials, wood, metal, polyethylene, or combinations thereof, and/or other materials used in shipbuilding.

Figure 4:
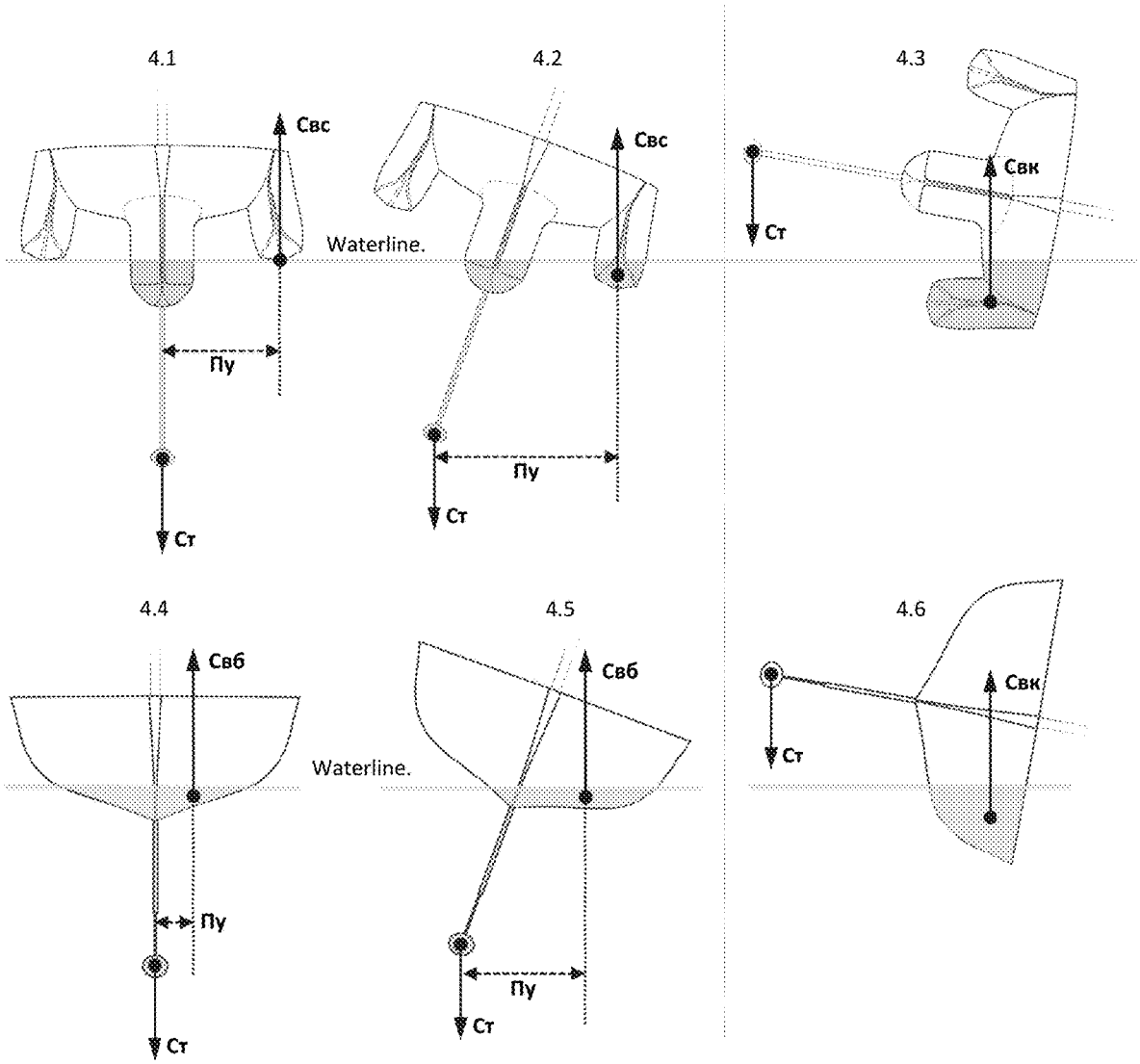

FIG. 4 (front view) demonstrates the operating principle of the claimed stabilised hull (4.1, 4.2 and 4.3) and its comparison with the hull of a conventional monohull keeled sail/power-sail boat (4.4, 4.5 and 4.6) in various modes, where the action of the following forces is shown:

4.1 and 4.4—at travel without a heel under sail (sailing downwind or using engine),

4.2 and 4.5—at 20 degrees heel to portside under sail,

4.3 and 4.6—in "sails on water" position, where:

$C_T$ is the gravitational force of the keel with a heavy bulb, $C_{BC}$—sponson water displacement force, $C_{B\delta}$—side of boat water displacement force, $C_{B\kappa}$—hull water displacement force, Πy-lever arm.

The size of the arrows showing forces are not proportional to their values.

In 4.1 and 4.2, the sponsons being located on maximum hull width ensure a large lever arm (Πy) of the sponson displacement force restoring moment ($C_{BC}$), and the hull thereby efficiently resists heeling under sail and swinging. The $C_{BC}$ is proportional to heel—the more the heel the more the submersion of the leeward sponson.

The wave is pierced by the stem and front lines of the sponsons; the wave energy is dissipated in the tunnel cavities, without bumping against the hull horizontal elements. The narrow section and the submerged narrow leeward sponson move in the displacement wave piercing mode with a low wave/hydrodynamic resistance, and do not limit the boat speed. When there is no heeling under sail, the sponsons are planning on their middle lines, preventing dipping into the wave. When the speed increases, the planning sponsons create additional lifting force, which resists heeling.

4.4 and 4.5. are featuring a conventional monohull keeled boat, where the lever arm (Πy) of the side of boat displacement force restoring moment ($C_{B\delta}$) is small, not exceeding one half of the width of the hull leeward side; so the restoring moment is also small—the hull swings on the waves and excessively heels under sail. The waves are pushed apart by the stem, and then further by the wide hull, creating thereby a high wave resistance in the displacement mode and limiting the boat speed.

All other conditions being equal, the illustrated 20 degrees heel under sail will be reached for the hull in 4.5 at lower wind velocity, than for the hull in 4.2.

In 4.3, in the critical "sails on water" position, the leeward sponson displacement is not sufficient for keeping the boat afloat and it is fully submerged, shifting the displacement centre closer to the boat centerline. The hull displacement force ($C_{B\kappa}$) is thus applied to the same point as in 4.6, ensuring in both cases the hull independent return to even keel.

For monohull keeled sail/power-sail boats, the claimed stabilised hull provides a combination of a narrow section with a single wave piercing displacement segment having a relative water line elongation L/W WL of 7× times or more (and, correspondingly, the use of the advantages of low wave/hydrodynamic resistance, high seaworthiness and motion stability) and at the same time (with a high sail area to displacement ratio of 7-10 m2 or more per tonne of displacement) an efficient stabilisation system (specifically, resistance to heeling under sail and swinging) for providing the hull static and dynamic stability at a better level, than in conventional monohull keeled sail/power-sail boats.

This results in rated speed increase of 2× or more times in the water displacement mode, or (which is similar) a 2-fold or more reduction of energy expenditure (sail or engine) required for moving the monohull keeled sail/power-sail boat from point A to point B.

At the same time, it ensures the following characteristics at the level of modern monohull keeled sail/power-sail boats: space and comfort of the living quarters and excellent steering capabilities.

The invention claimed is:

1. A stabilised hull of a monohull keeled sail/power-sail boat characterised by the hull total width not exceeding 50% of its length, which in its lower part is embodied with a longitudinally arranged, symmetrical in relation to the boat centerline and commensurate to its length, vertically oriented narrow section of low wave/hydrodynamic resistance, with a water displacement segment, including a keel with a blade holding a heavy bulb, therein, the length-to-width ratio of that segment waterline is at least 7× times, with the segment water displacement corresponding to the fully loaded weight of the boat, therein, the narrow section is embodied with wave piercing lines, a high wave piercing stem, streamlined back lines, and a streamlined spatial widening in the upper front part thereof, it also includes two longitudinally oriented, symmetrical in relation to the boat centerline, sponsons, located above the waterline along the bottom surface of the hull at maximum hull width; in relation to the hull length, the sponsons may be located either closer to the stern, the middle or to the bow part of the hull, therein, the sponson length-to-width ratio is at least 7× times, with its own volume sufficient for parrying heeling under sail at submersion of the leeward sponson, but not sufficient for keeping the boat afloat, therein, the sponsons have a streamlined, spindle-shaped form with wave piercing front, streamlined rear and planning middle lines, forming above the waterline two tunnel cavities between the narrow section and each of the sponsons, of the size sufficient for dissipating the energy of the wave broken by the stem and the sponsons;

wherein, when the boat is at rest in the water, said water displacement segment projects beneath the waterline and possesses sufficient width to carry the fully loaded weight of the boat whilst said sponsons remain above said waterline; said keel's blade and bulb extending to a greater depth from the waterline than the distance between the center line of the displacement segment and the center line of each sponson.

* * * * *